United States Patent [19]

Bingham

[11] Patent Number: 4,458,620

[45] Date of Patent: Jul. 10, 1984

[54] BOAT MOORING APPARATUS

[76] Inventor: Lowell B. Bingham, 1026 Longview Dr., West Chester, Pa. 19380

[21] Appl. No.: 374,957

[22] Filed: May 5, 1982

[51] Int. Cl.[3] ..... B63B 21/54

[52] U.S. Cl. ..... 114/230; 114/231; 114/249; 114/252; 14/69.5

[58] Field of Search ..... 114/230, 231; 14/69.5

[56] References Cited

U.S. PATENT DOCUMENTS

| | | | |
|---|---|---|---|
| 2,845,892 | 12/1954 | Jorgenson | 114/230 |
| 2,965,064 | 12/1960 | Wallace | 114/230 |
| 2,996,033 | 8/1961 | Yordi | 114/230 |
| 3,060,885 | 4/1962 | Nolf | 114/230 |
| 3,177,839 | 10/1963 | Nolf | 114/230 |
| 3,442,241 | 5/1969 | Daunis | 114/230 |
| 3,763,816 | 10/1973 | Wilson | 114/230 |
| 3,918,386 | 11/1975 | McClain | 114/230 |
| 4,143,613 | 3/1979 | Paul | 114/230 |

FOREIGN PATENT DOCUMENTS

| | | | |
|---|---|---|---|
| 133773 | 3/1960 | U.S.S.R. | 114/230 |

*Primary Examiner*—Trygve M. Blix
*Assistant Examiner*—Patrick Young
*Attorney, Agent, or Firm*—Richard L. Hansen

[57] ABSTRACT

Apparatus is provided for mooring a water-borne boat to a dock. The apparatus includes a pair of spring wires extending from the dock and over the water to brackets supporting a horizontal roller to be engaged by a boat-mounted latch.

13 Claims, 5 Drawing Figures

BOAT MOORING APPARATUS

This invention is in the field of devices for mooring a water-borne boat; more specifically, apparatus which automatically catches an approaching boat and secures it at a dock.

Small craft are kept in the water for recreational boating at lakes, streams and seashores throughout the world. Such craft generally do not exceed about 24 feet in length, and they are usually moored in slips or alongside docks. Mooring such craft at a slip or dock without damaging them has often presented a problem, especially when the weather turns bad and the wind and wave action increases. The problem becomes acute when the boat is operated single-handedly and line handlers are not available.

Over the years many systems and devices have been proposed to overcome this problem. Ropes and lines, traditionally used to secure boats to docks, are employed in a number of mooring devices described in the prior art. For example, U.S. Pat. No. 3,763,816 discloses a complicated system which utilizes ropes to automatically catch an approaching boat, slow it, and then secure it in a slip without any manual line handling being required.

A rope or line at the dock has been coupled with a boat-mounted mechanical hook or rope-engaging member in several schemes. U.S. Pat. Nos. 3,918,386 and 4,143,613 describe systems which catch an approaching boat, but require further ropes to secure the boat to the dock. Furthermore, the device disclosed in U.S. Pat. No. 3,918,386 requires physical modification to the boat to retrofit it. The boat mooring system disclosed in U.S. Pat. No. 2,845,892 utilizes a pair of boat-mounted hooks to engage complementary cables at the dock. The boat is caught at one cable and then secured by engaging the second hook/cable combination.

One of the problems with automatic mooring systems lies in mating the complementary coupling elements when the boat is pitching and yawing due to wind and wave action. If one of the elements is a rope, line, or cable this problem is lessened, because the latter can be engaged anywhere along their length, and it is only necessary to line up a mechanical member, a hook or latch generally mounted at the bow of the boat, anywhere along the rope, line, or cable to catch the boat. Still, alignment is required, and this can be difficult in bad weather, especially when single-handed.

This difficulty is recognized in U.S. Pat. Nos. 3,060,885 and 3,177,839, both to Nolf. In the devices described by Nolf the difficulty caused by boat pitching is handled by providing a boat-mounted vertical bar for engagement by a dock-mounted latch. The Nolf inventions attempt to address the added problem caused by yawing of the boat. Ropes or a V-shaped entry are provided to guide the vertical bar into the latch. Nevertheless, catching and securing the boat requires centering the boat on the latch mechanism. Once the boat is secured, the Nolf mooring apparatus is subjected to considerably stress in rough seas, because no lateral motion of the boat is permitted.

Thus, it is one object of this invention to provide a simple, automatic, single-handed boat mooring system which does not require the use of ropes, lines, or cable. It is another object of this invention to provide mooring apparatus which functions reliably in adverse weather and does not require precise alignment of the coupling elements to secure the boat. Other objectives will be apparent to those skilled in the art to whom this application is directed.

In attaining these objectives this invention provides mooring apparatus which utilizes an elongated horizontal roller to engage the approaching boat, contact with the boat forcing the roller downward into a latch, where the roller is secured. Since the latch secures the roller anywhere along its length, lateral yawing of the boat does not adversely affect alignment of the coupling elements. Furthermore, the boat itself provides a second elongated element to be engaged by the roller even if the boat is pitching. The natural approach motion of the boat secures the coupling elements.

In more specific terms, according to this invention there is provided apparatus for mooring a water-borne boat to a dock which includes a pair of curved spring wires spaced apart with the inboard ends thereof affixed at a dock member, said spring wires extending over the water beside the dock with the outboard ends thereof affixed at a pair of frame brackets; and a horizontally disposed cylindrical docking roller on a roller shaft held over the water by suspending the ends thereof on bearings in said frame brackets for rotation about the roller shaft axis; together with latch means mounted on the boat at a height over the water lower than the height of said docking roller; whereby the boat is moored by engaging said docking roller with the moving boat, whose motion flexes said spring wires and forces said docking roller down and into said latch means.

Various advantages and novel features which characterize this invention are particularly pointed out in the appended claims. However, for a better understanding of the invention, its advantages, and the objectives to be attained by its use, reference should be made to the drawings, which illustrate preferred embodiments containing optional features, and to the following description.

Figure 1:
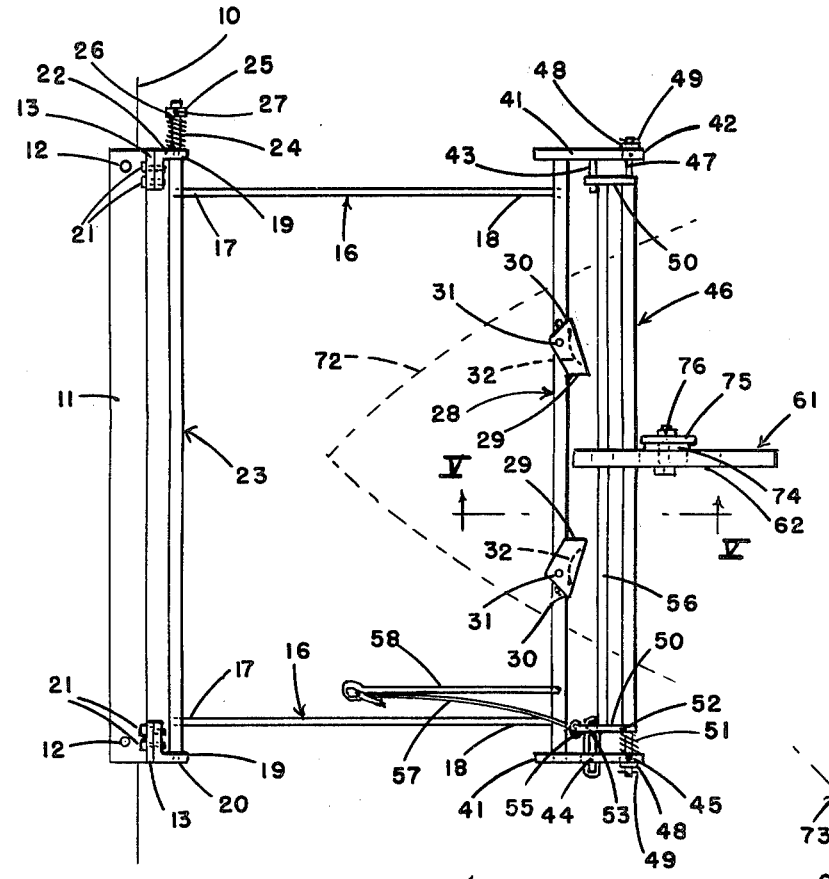
FIG. 1 is a top plan view of boat mooring apparatus according to this invention.

Referring now to the drawings, horizontal dock member 10, which, e.g., may be the edge of a dock at the end of a boat slip, or may be a separate beam mounted perpendicular to the run of the dock, provides a base to which inboard ends 17 of curved spring wires 16 are affixed. The spring wires are spaced apart and extend over the water beside the dock.

There are a number of ways in which the spring wires can be affixed at the dock member. For example, by direct attachment, or angle 11 may be optionally fastened to dock member 10 with fasteners 12, and a pair of standards 13 can be mounted vertically from dock member 10 or angle 11, if present, by means of fasteners 15. Vertical adjustment is provided by holes 14 in the standards. The inboard ends 17 of spring wires 16 can be attached directly to the standards. Alternatively and optionally, inboard ends 17 can be attached to a counterbalance shaft 23, the ends of which are held at a pair of shaft brackets 19. The shaft brackets may be attached to standards 13 with fasteners 21, holes 14 permitting vertical adjustment.

It will be evident that in the event the mooring apparatus is to be used in tidal waters, any of dock member 10, angle 11, or standards 13 can be affixed to float means, such as disclosed in the prior art cited above, for example, rather than a stationary dock or pier. The apparatus can also be used with floating docks.

Outboard ends 18 of spring wires 16 are affixed at a pair of frame brackets 41. The frame brackets hold the ends of roller shaft 47 on bearings 42 therein for rotation about the roller shaft axis. Roller shaft 47 carries cylindrical docking roller 46. The docking roller is horizontally disposed over the water. Washers 48 and pins 49 may be provided to maintain the roller shaft in bearings 42. Although spring wire outboard ends 18 can be attached directly to frame brackets 41, the apparatus is stronger if frame bar 28 connects the frame brackets inboard of the docking roller and outboard ends 18 are then joined to the bar.

In mooring a boat, docking roller 46 is caught by latch means, generally mounted on the bow, especially the stem, of the boat. However, the latch means could be mounted elsewhere, on the stern, for example. In order to attain the fully automatic latching intended by the invention, the latch should be mounted at a height over the water lower than the height of the docking roller and preferably lower than the height of inboard ends 17. The difference in height between the inboard ends of the spring wires and the latch means will then vary, depending upon the specifics of the apparatus and the boat, but at least about 6 inches is often satisfactory. The height of inboard ends 17 and docking roller 46 can be adjusted by changing the positions of angle 11 or shaft brackets 19 and standards 13 using holes 14.

If finer vertical adjustment is required, the ends of counterbalance shaft 23, which should then be cylindrical, can be held at shaft brackets 19 by suspension on bearings 20 therein for rotation about the counterbalance shaft axis, thereby permitting inboard ends 17 to pivot. Spring means are employed to bias the counterbalance shaft against the rotational moment of docking roller 46. Although other spring means can be used, it is advantageous to employ a torsional spiral spring 24 connected adjustably between at least one of the shaft brackets, e.g., at attachment point 22, and attachment point 26 on collar 25. The collar rides on the counterbalance shaft for rotation thereon. The tension of spring 24 is adjusted by manipulating set screw 27 and rotating the collar.

Figure 4:
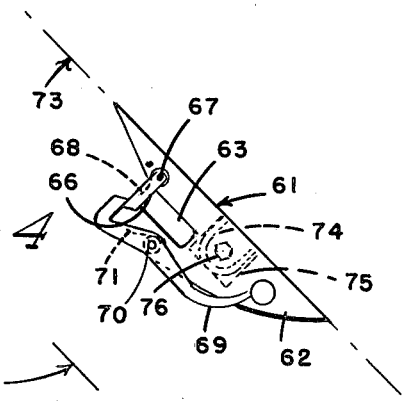
FIG. 4 is a fragmentary side view like FIG. 2, but showing an alternate version of part of the apparatus.

A number of different boat-mounted latch means, some of which are disclosed in the prior art cited above, can be used to engage docking roller 46 and secure the boat. A suitable latch 61 (shown in the closed position) is illustrated in FIG. 4. The latch is intended to be mounted on bow eye 74 generally found on stem 73 of the boat. Latch plate 62 is fastened on one side of the bow eye by means of backing plate 75 and fastener 76. The latch plate has an elongated latch pocket 63 sized to accommodate docking roller 46 transversely. Keeper 66 is pivotally attached to the latch plate with fastener 67, the keeper being urged upward, opening the latch pocket, by spring means, e.g., fixed wire spring 68. Retainer 69 is pivotally attached to the latch plate with fastener 70 and is urged into the position shown in FIG. 4 by spring means, e.g., fixed wire spring 71. It will be evident that keeper 66 will be urged upward, opening the latch pocket, if retainer 69 is pivoted in a counterclockwise direction, thereby permitting docking roller 46 to pass into or out of latch pocket 63.

Figure 3:
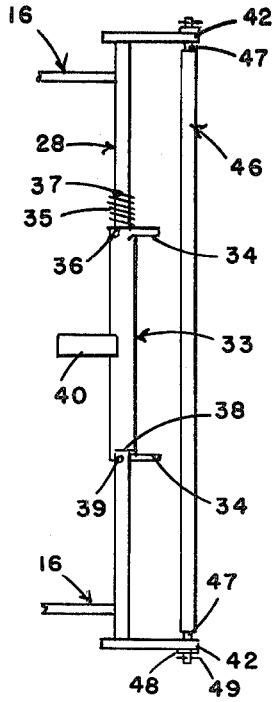
FIG. 3 is a fragmentary top plan view like FIG. 1, but showing an alternate version of part of the apparatus.

In mooring a boat having the latch means shown in FIG. 4, docking roller 46, e.g., as shown in FIG. 3, encounters stem 73, and the forward motion of the boat forces the docking roller down the stem. Latch plate 62 directs the docking roller into latch pocket 63, at the same time carrying keeper 66 downward against retainer 69, which is forced in counterclockwise rotation, passing keeper 66 and docking roller 46. When the docking roller approaches the bottom of latch pocket 63, keeper 66 is freed and urged upward until it encounters retainer 69, where the keeper is held, closing the latch pocket and securing the boat.

Figure 2:
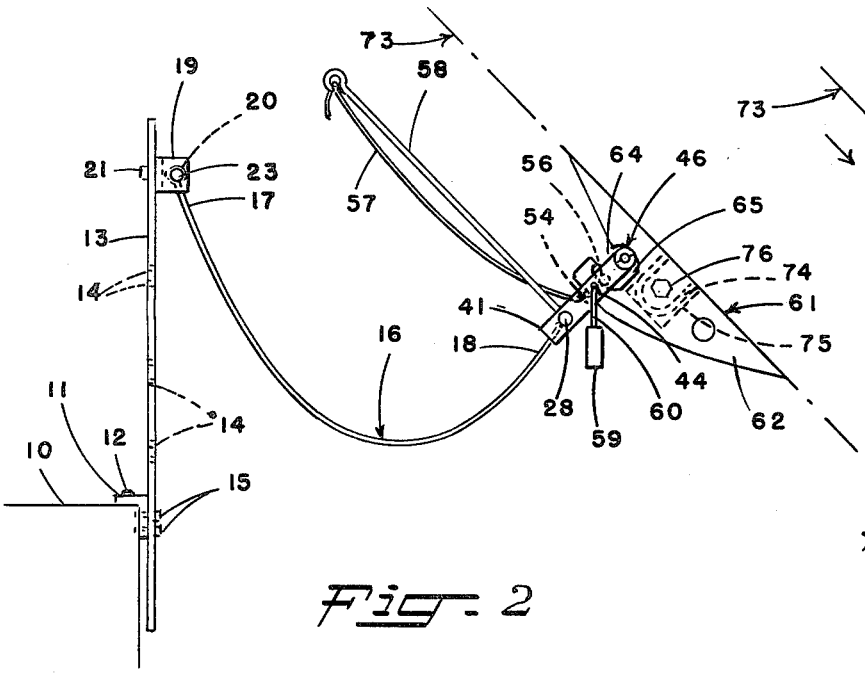
FIG. 2 is a side view of the apparatus of FIG. 1.

Alternate latch means is illustrated in FIGS. 1 and 2 and differs from the latch just described in having no moving parts. This latch is characterized by a latch pocket with a throat 64 of lesser width than a connected retention cavity 65. This latch may be used with apparatus which optionally includes latch rod 56 parallel to and spaced from docking roller 46 a distance greater than the width of entrance throat 64.

The ends of latch rod 56 are attached to a pair of end brackets 50. The end brackets are suspended from roller shaft 47 for rotation about the roller shaft axis. At least one stop is provided, e.g., stop 43 on frame bracket 41, against which at least one of the end brackets 50 is urged by spring means. A number of different spring means are suitable. For example, torsional spiral spring 51 may be wrapped on roller shaft 47 with the ends thereof fastened at attachment point 45 of frame bracket 41 and attachment point 52 of end bracket 50, respectively.

Figure 5:
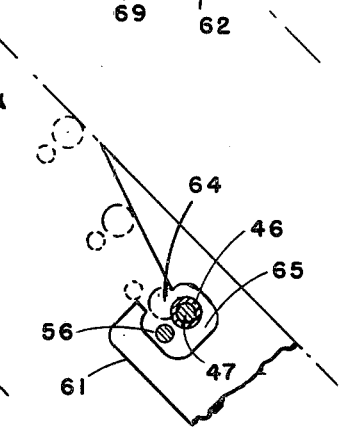
FIG. 5 is a partial sectional view taken along line V—V of FIG. 1 showing the times sequential operation of the parts shown.

For an understanding of the operation of the apparatus of FIGS. 1 and 2 in mooring a boat, attention is directed to FIG. 5. When docking roller 46 is encountered by boat 72 the docking roller is forced downward into throat 64 of latch 61, in turn rotating end bracket 50 away from stop 43. This permits the latch rod to pass through throat 64 following docking roller 46 and into retention cavity 65, whereupon end bracket 50 is again urged against stop 43, preventing accidental disengagement of the docking roller from the latch. In order to permit disengagement of latch rod 56 from retention cavity 65 to unmoor the boat, unlatching means optionally may be provided. A number of methods can be used to rotate end bracket 50 away from stop 43, permitting both the latch rod and the docking roller to disengage from the latch. For example, a foot operated lever mounted for rotation on frame 28 can be employed. Alternatively, lanyard ring 55 may be attached to end bracket 50 through opening 54 and lanyard 57 connected from the ring to a point readily accessible from the dock. For this purpose, post 58 mounted on frame bar 28 can take the other end of the lanyard for convenient access. Pulling the lanyard will rotate end bracket 50 away from the stop 43, permitting unmooring.

The apparatus of this invention permits lateral motion of the moored boat to the extent travel of latch 61 along docking roller 46 is not restricted. Some lateral motion is desirable in that it minimizes wear and tear on the apparatus, the boat absorbing some of the force from the wind and waves. However, in confined quarters it may be required to restrict the lateral motion of the moored boat. The motion can be controlled by providing centering means for maintaining the midline of the boat near the center of docking roller 46. Several types of centering means may be used.

For example, a pair of pawls 29 may be provided on frame bar 28. The pawls are pivotally retained on the frame bar by fasteners 31 and are urged into normally closed position such that tangs 30 are stopped against the frame bar by spring means, e.g., fixed springs 32. The pawls are sized so that latch 61 will pass from either end of the frame bar to the center by pivoting the pawls, but will then be retained between the pawls.

A number of other techniques for centering the boat will be evident to those skilled in the art. For example, referring to FIG. 3, other means may include a sleeve 33 encircling a cylindrical frame bar 28 for axial rotation thereon. The sleeve carries latch retention fingers 34 at either end thereof. The fingers are rotated by lever bar means 40 attached to the sleeve between an open position in which the fingers pass a latch from either end of the frame bar and a closed position (shown in FIG. 3) in which the latch may be retained between the fingers. The open and closed positions are fixed by the circumferential extremes of sleeve cutout 38, which are stopped against pin 39. The fingers are urged into the closed position by spring means, such as torsional spiral spring 35 wrapped on the frame bar and connected across sleeve 33 at attachment 36 and the frame bar at attachment 37.

A particular advantage of the mooring system of this invention is that the moor boat can easily be secured against theft. For example, mating shackle holes 44 and 53 provided in frame bracket 41 and end bracket 50, respectively, can be threaded by shackle 60 of lock 59.

The mooring apparatus of this invention can be constructed using materials readily available in commerce which will be familiar to those skilled in the art. Among these materials are iron and steel, especially galvanized or stainless steel, but plastics, especially reinforced plastics such as fiberglass, can also be employed for all or part of the apparatus.

It will be apparent that a number of modifications and variations in the details of the invention can be made while remaining within the scope of the following claims.

What is claimed is:

1. Apparatus for mooring a water-borne boat to a dock which comprises a pair of curved spring wires spaced apart with the inboard ends thereof affixed at a dock member, said spring wires extending over the water beside the dock with the outboard ends thereof affixed at a pair of frame brackets;

a horizontally disposed cylindrical docking roller on a roller shaft held over the water by suspending the ends thereof on bearings in said frame brackets for rotation about the roller shaft axis; together with latch means mounted on the boat at a height over the water lower than the height of said docking roller;

whereby the boat is moored by engaging said docking roller with the boat, whose motion flexes said spring wires and forces said docking roller down and into said latch means.

2. The apparatus of claim 1 wherein the inboard ends of said spring wires are affixed at standards mounted vertically from said dock member.

3. The apparatus of claim 2 wherein the inboard ends of said spring wires are attached to a counterbalance shaft, the ends of which are held at shaft brackets attached to said standards.

4. The apparatus of claim 3 wherein a frame bar is connected to said frame brackets inboard of said docking roller, and the outboard ends of said spring wires are affixed at said frame brackets by attachment to said frame bar.

5. The apparatus of claim 4 wherein said counterbalance shaft is cylindrical and suspended for rotation about the counterbalance shaft axis on bearings in said shaft brackets, and adjustable spring means are provided to control the degree of rotation.

6. The apparatus of claim 5 wherein said latch means includes a latch pocket having an entrance throat of lesser width than a connected retention cavity.

7. The apparatus of claim 6 further comprising a latch rod parallel to and spaced from said docking roller a distance greater than the width of the entrance throat of said latch pocket and attached at either end thereof to end brackets suspended from said roller shaft for rotation about the shaft axis, together with spring means for urging at least one of said end brackets against a stop, whereby said end bracket is forced away from the stop when said docking roller enters said latch pocket, permitting said latch rod to pass through the throat of said latch pocket and into the retention cavity, whereupon said end bracket is again urged against said stop, preventing accidental disengagement of said docking roller from said latch pocket.

8. The apparatus of claim 7 wherein centering means are provided for maintaining the midline of the moored boat near the center of said docking roller.

9. The apparatus of claim 8 wherein the centering means includes spring-loaded pawls pivotally connected to said frame bar to pass said latch means from either end of said frame bar, but then retain it between the pawls.

10. The apparatus of claim 8 wherein the centering means comprises a sleeve with fingers at either end thereof, the sleeve encircling said frame bar for rotation about the axis thereof between an open position in which the fingers pass said latch means from either end of said frame bar and a closed position in which said latch means may be retained between the fingers, together with means for rotating said sleeve between the open and closed positions.

11. The apparatus of claim 9 including unlatching means for rotating said end bracket away from said stop, permitting said latch rod and said docking roller to disengage from said latch pocket, thereby unmooring the boat.

12. The apparatus of claim 11 wherein mating shackle holes are provided in at least one of said frame brackets and adjacent end bracket, permitting insertion of the shackle of a lock to secure the moored boat.

13. Apparatus for mooring a water-borne boat to a dock which comprises a pair of spring wires spaced apart with the inboard ends thereof attached to a cylindrical counterbalance shaft whose ends are suspended on bearings in shaft brackets for rotation about the counterbalance shaft axis, the degree of rotation being controlled by adjustable spring means, said shaft brackets being attached to adjustable standards mounted vertically from a dock member;

a pair of frame brackets connected by a frame bar attached to the outboard ends of said spring wires, said frame brackets having bearings to hold the shaft of a cylindrical docking roller horizontally disposed over the water for rotation about the roller shaft axis;

a latch mounted on the boat at a height over the water lower than the height of said docking roller and including a latch pocket having an entrance throat of lesser width than a connected retention cavity;

a latch rod parallel to and spaced from said docking roller a distance greater than the width of the entrance throat of said latch pocket and attached at either end thereof to end brackets suspended from the roller shaft for rotation about the shaft axis, with spring means for urging at least one of said end brackets against a stop;

unlatching means for rotating said end brackets away from said stop; and a pair of spring-loaded pawls pivotally connected to said frame bar to pass said latch from either end of said frame bar, but then retain said latch between the pawls.

* * * * *